United States Patent [19]

Horvath

[11] Patent Number: 4,461,420

[45] Date of Patent: Jul. 24, 1984

[54] VENTABLE PACKAGE COVER

[75] Inventor: Laszlo S. Horvath, Geneva, Switzerland

[73] Assignee: Cod Inter Techniques SA, Geneva, Switzerland

[21] Appl. No.: 436,181

[22] Filed: Oct. 22, 1982

[30] Foreign Application Priority Data

Mar. 5, 1982 [CH] Switzerland ..... 1340/82

[51] Int. Cl.[3] ..... B65D 81/34; B65D 51/16

[52] U.S. Cl. ..... 229/43; 206/484.1; 206/439; 383/102; 426/118; 426/113; 426/395; 426/396; 220/257; 220/367; 220/371

[58] Field of Search ..... 426/118, 395, 415, 396, 426/412, 407, 113, 122, 123; 206/439, 484.1; 220/257, 371, 372, 367; 229/43; 383/102

[56] References Cited

U.S. PATENT DOCUMENTS

| | | | |
|---|---|---|---|
| 3,083,861 | 4/1963 | Amberg et al. | 220/371 |
| 3,158,491 | 11/1964 | Farrell et al. | 426/123 |
| 3,298,505 | 1/1967 | Stephenson | 426/123 |
| 3,410,395 | 11/1968 | Sellers | 206/439 |
| 3,432,087 | 3/1969 | Costello | 426/118 |
| 3,547,257 | 12/1970 | Armentrout | 206/439 |
| 3,716,180 | 2/1973 | Bemiss et al. | 426/118 |
| 3,776,450 | 12/1973 | Christensson | 229/7 R |
| 3,806,618 | 4/1974 | Bemiss | 426/118 |
| 3,946,780 | 3/1976 | Sellers | 426/118 |
| 4,055,672 | 10/1977 | Hirsch et al. | 426/123 |
| 4,063,383 | 12/1977 | Green | 206/439 |
| 4,096,948 | 6/1978 | Kuchenbecker | 426/122 |
| 4,136,796 | 1/1979 | Dubois et al. | 220/371 |

FOREIGN PATENT DOCUMENTS

| | | | |
|---|---|---|---|
| 2539351 | 3/1977 | Fed. Rep. of Germany | 426/410 |
| 2025894 | 1/1980 | United Kingdom | 206/439 |

*Primary Examiner*—Steven L. Weinstein
*Attorney, Agent, or Firm*—Pennie & Edmonds

[57] ABSTRACT

A vapor outlet valve for packages, consisting of a valve film welded to the inner surface of the capping film of the package in such a way that it is exposed when a predetermined section of the capping film is torn off.

7 Claims, 4 Drawing Figures

VENTABLE PACKAGE COVER

SUMMARY OF THE INVENTION

The invention refers to a vapour outlet valve for packages, consisting of a valve film (5) welded to the inner surface of the capping film of the package in such a way that it is exposed when the capping film is torn off along a predetermined rupture line (1).

The invention more particularly refers to a vapour outlet valve defined hereinabove, characterized in that the film comprising the valve possesses a microporous or porous structure which promotes permeability to gas and vapour, and that the physical properties of the basic material of the film may render it water-repellent and impermeable to liquids and colloids.

BACKGROUND OF THE INVENTION

The object of the invention hereinafter described is a valve incorporated in the capping film of a package, which permits the vapours evolved during heating of the contents to escape without permitting the heating medium (usually water) to penetrate the contents.

Expansion of the liquid contents and evaporation of the aqueous constituents when the contents of a ready-to-serve meal packed in a semi-solid dish, for example, are heated results in the production of an overpressure which causes hot liquid fragments of the contents to spurt out when the package is opened. This fact may impose a restriction on the use of otherwise suitable ready-to-serve dishes.

The invention described hereinafter resolves the problem by incorporation of a valve in the capping film, which is only exposed immediately prior to heating of the contents of the package.

PREFERRED EMBODIMENTS OF THE INVENTION

Figure 4:
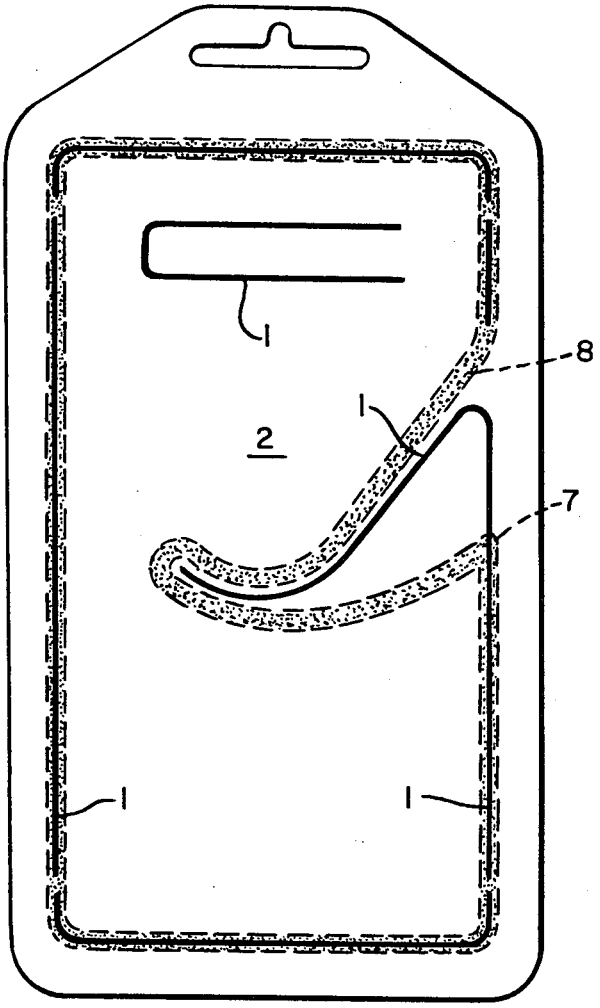

FIG. 4 describes, by way of example, a package with a tear-off capping film fitted with an outlet valve in accordance with the invention.

For the purpose of this invention, a tearing line (1) totally independent of the tearing line for opening the package is provided which, after the section of the tear-off capping film circumscribed by the tear-off line (1) is removed, creates an opening which, however, remains sealed by a film (3) welded to the inner surface of the capping film.

The capping film comprises three principal sections: an outer film (2) of low elasticity coated with a layer of plastic (3), the layer of plastic (3) being welded to a film (4) made of the same plastic.

If the film (4) is a multilayer composite film, the outermost layer must be identical to the said plastic layer (3).

The valve film (5) forming the object of this invention is made of the same basic material as the film (4) or the inner layer of the film (4) with which is bonded tightly and hermetically over the weld area (7) characterized by the recess (6). The weld contour is represented by the line (8).

The valve film (5) is made of one of the well-known, water-repellent, microporous films.

Figure 1:
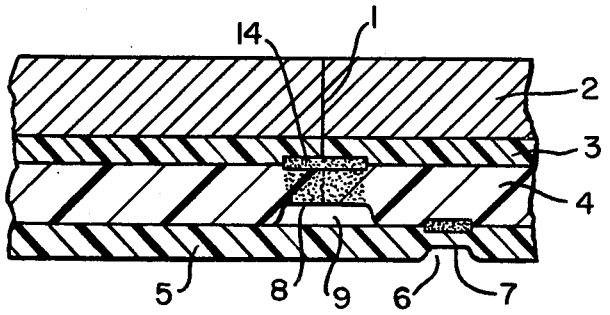
FIG. 1 shows a sectional view of the capping film and of the outlet valve in accordance with the invention.
Figure 2:
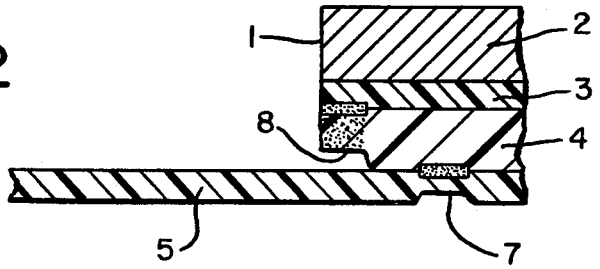
FIG. 2 shows a sectional view of the assembly described by FIG. 1 after removal of the protective film.
Figure 3:
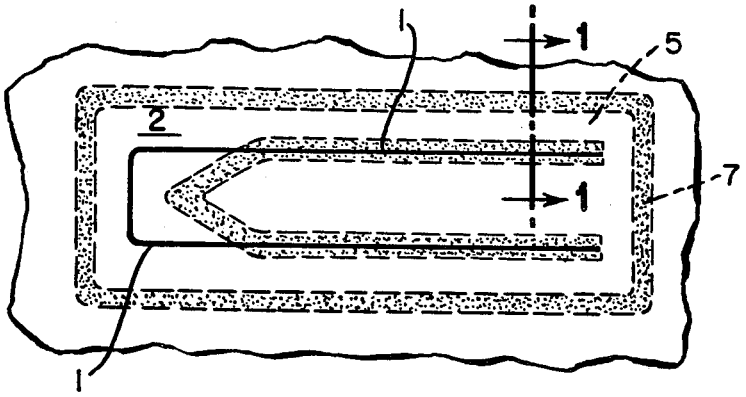
FIG. 3 is a plan view of the outlet valve in accordance with the invention.

During preparation of the capping film of the package, a tearing line (1) in the form of a predetermined rupture line is provided within the line (7) which represents the weld line of the valve film, in such a way that the weld line (8) bonding the film (2) to the film (4) by the plastic layer (3) and represented in sectional view in FIG. 1 by the weld area (14) and the recess (9), covers most of the tearing line (1), with the exception of the opening tab, where the weld line (8) tapers to a point at which tearing is initiated.

When the capping film is torn off along the tearing line (1) and the weld line (8), the valve film (5) is exposed, tearing of the film being facilitated by an actual tearing line.

The valve film (5) is exposed immediately prior to heating. The valve film (5) permits the vapour produced inside the package during heating to escape without permitting the liquid portion of the contents to escape or the water used for heating to penetrate the package. The pressure built up during heating is thereby reduced and the package can be opened without the hot contents spurting out.

The outer film (2) is made from a material of low elasticity, such as aluminium, paper, suitable plastic or other film material of low elasticity. The film (2) is coated with a thin adhesive layer (3) made of the same thermoplastic as the inner film (4). In a preliminary operation, an incision is made in the film (2) and the adhesive layer (3), the contour of the incision forming a predetermined rupture line (1) along which tearing will occur.

Following establishment of the predetermined rupture line (1), the film (2) is welded to the film (4) by the adhesive layer (3). Like the majority of films manufactured by blow moulding, the film (4) possesses a biaxial molecular orientation. During welding, the thermoplastic is fused to the film, thereby destroying most of the molecular orientation to which the tearing strength of the film is largely due.

The weld area is further weakened by a recess formed by the sealing pressure during welding. Notching produced, for example, by ridges or other surface patterns on the welding tool may induce even further weakening.

The capping film is torn off by gripping the opening tab with the fingers and tearing the point off first. The tear is then extended along the predetermined rupture line (1) in the film until that section of the film circumscribed by the predetermined rupture line is torn off. During tearing, the weld area is torn off along the actual tearing line.

The purpose of the invention is the pressure relief of packages, particularly packages of foodstuffs which must be heated prior to use, preferably by immersion in boiling water. The valve is hermetically sealed by the capping film prior to use; before or after heating, the capping film is torn off, thereby exposing the valve. The valve is a thermoplastic, microporous or porous film welded to the inner surface of the capping film. The valve film may be permeable to water vapour but impermeable to water; this precludes mixing of the water used for heating with the contents. Consequently, the contents do not spurt out when the package is opened.

What I claim is:

1. A package cover capable of being secured to and covering a container, said cover comprising:

(a) a vapor and liquid impermeable capping film including first and second, discrete films:

(i) the first film having a tear line extending around a predetermined area, and (ii) the second film located below and secured to the first film along at least most of said tear line to form a weakened portion in said second film extending below said at least most of the tear line to facilitate tearing the second film along the tear line; and (b) a vapor permeable, liquid impermeable inside film located below and secured to the second film of the capping film along a path outside of and extending around said tear line, said inner film being unsecured to the second film of the capping film in said predetermined area such that tearing the capping film along the tear incision and away from the inside film exposes the inside film to the ambient atmosphere to render the package cover vapor permeable.

2. A package cover according to claim 1 wherein:

(a) the inside film is welded to the capping film along said path;

(b) the tear line is an incision extending through the thickness of said first film.

3. A package cover according to claim 1 wherein the weakened portion of the second film is formed by welding the second film to the first film directly below most of the tear line.

4. A package cover according to claim 1 wherein the weakened portion of the second film forms a recess extending below most of the tear line.

5. A package cover according to any one of claims 1–4 wherein:

(a) the first film of the capping film is constructed of a vapor and liquid impermeable material; and (b) the second film of the capping film is constructed of the same vapor permeable, liquid impermeable material as said inside film.

6. A package cover according to claim 5 wherein the first film of the capping film includes a layer of material facing the second film, said layer being of the same material as the second film.

7. A package cover according to claim 6 wherein the layer material and second film of the capping film and the inside film are all of the same thermoplastic material and secured to each other by fusing with the fusing of the second film to the plastic layer of the first film covering the overlying tear line.

* * * * *